US005111640A

United States Patent [19]

Tokunaga et al.

[11] Patent Number: 5,111,640

[45] Date of Patent: May 12, 1992

[54] PACKAGING CONTAINER AND PACKAGING METHOD OF ACRYLAMIDE CRYSTAL

[75] Inventors: Mareo Tokunaga, Kaizuka; Wataru Isozaki, Takaishi, both of Japan

[73] Assignee: Mitsui Toatsu Chemicals, Inc., Tokyo, Japan

[21] Appl. No.: 573,702

[22] Filed: Aug. 28, 1990

[30] Foreign Application Priority Data

Sep. 5, 1990 [JP] Japan ..... 1-228368

[51] Int. Cl.[5] ..... B65B 55/00

[52] U.S. Cl. ..... 53/449; 53/474

[58] Field of Search ..... 53/472, 469, 449, 474; 206/204

[56] References Cited

U.S. PATENT DOCUMENTS

| | | | |
|---|---|---|---|
| 2,283,867 | 5/1942 | Flosdorf | 53/449 X |
| 2,447,258 | 8/1948 | Lobley | 53/449 X |
| 2,524,162 | 10/1950 | Chavannes | 53/449 X |
| 2,682,465 | 6/1954 | Wiitala | 53/474 X |
| 3,728,839 | 4/1973 | Glick | 53/449 X |
| 4,734,292 | 3/1988 | Van Boxtel | 53/449 X |

*Primary Examiner*—John Sipos

*Attorney, Agent, or Firm*—Burns, Doane, Swecker & Mathis

[57] ABSTRACT

A packaging container for acrylamide crystals comprising (a) an inner bag consisting of a packaging material having moisture permeability in order to package acrylamide crystals, (b) an interlayer bag consisting of a packaging material having impermeability to atmospheric water-vapor and a gas-barrier property, and, if necessary, (c) an outer bag consisting of an exterior material, and a method for packaging acrylamide crystal by using the above container, is disclosed. According to the present invention, contamination of foreign particles such as lint and dust or tackiness due to moisture can be prevented in transportation and storage.

5 Claims, No Drawings

PACKAGING CONTAINER AND PACKAGING METHOD OF ACRYLAMIDE CRYSTAL

BACKGROUND OF THE INVENTION (1) Field of the Invention

The present invention relates to a packaging container for acrylamide crystals and a packaging method for acrylamide crystals. More particularly, the present invention relates to a packaging container and a packaging method for preventing condensation of moisture contained in the crystals on the inside surface of an inner bag when the temperature is changed in transportation or storage.

(2) Description of the Related Art

Acrylamide can be prepared by a process for catalytically hydrating acrylonitrile in the presence of a catalyst containing metallic copper as a primary component or by a process for hydrating acrylonitrile through the action of microorganisms Acrylamide is a very useful compound which is widely used as a raw material for polyacrylamide having many applications such as flocculant, paper reinforcing agent and petroleum salvaging agent.

Acrylamide is produced in the form of an aqueous solution, and usually transported or stored as a 30 to 50% aqueous solution. It is also used for polymerization reaction in the form of an aqueous solution.

However, crystallized acrylamide is required in the case of transporting over a long distance, storage in a cold district or use in a non-aqueous system.

Crystallized acrylamide is precipitated by concentrating and cooling the aqueous acrylamide solution and obtained by successively filtering and drying.

The crystallized acrylamide thus obtained is usually packed in a multi-ply paper bag composed of one plastic layer such as polyethylene, polypropylene and vinylidene chloride and 3 to 5 layers of kraft paper, and transported or stored.

In order to correspond to a specific application where contamination of foreign substances must be carefully prevented, a packaging obtained by using a double-ply inner bag such as polyethylene bag or polypropylene bag is placed in a pail can, completely sealed, and further packaged in a corrugated box and is transported or stored.

However, the crystallized acrylamide thus obtained often leads to some trouble that moisture contained in the crystal condenses on the inside surface of the inner bag in transportation or storage. In packing powder or crystals, a packaging method which maintains its dry state by using a moisture-proof packaging material and a drying agent for packaging, is generally employed in order to protect the package content from outside moisture. In such case, the content to be packaged is sufficiently dried prior to packing.

In packaging the crystallized acrylamide, moisture contained in the crystals is condensed on the inside surface of the inner bag in transportation and storage and hence the above packaging method cannot solve the problem of moisture condensation. By directly adding a package of drying agent such as silica gel into the inner bag containing acrylamide crystal, the moisture condensation on the inside surface of the inner bag can be generally prevented. However, a packing bag of the drying agent can be broken by mechanical friction with acrylamide crystals during transportation and causes troubles. For example, when the acrylamide crystals around the drying agent are examined by dissolving the crystals in water, lint like foreign particles are found. Such particles lead to problems in use. In other cases, the drying agent and acrylamide crystals are mixed in the packaging bag and extremely complicated procedures are required for selectively picking out the drying agent.

On the other hand, in the steps of concentrating, cooling and precipitating the aqueous acrylamide solution and filtering and drying the crystallized acrylamide, the resulting crystals are pulverized in the course of reducing the moisture content of the crystal as low as possible. Thus, problems on safety and health result from the dust generated. Even though the moisture content of the crystal is reduced from the usual range of 0.5 to 1.0 wt. % to the range of 0.2 to 0.5%, moisture condensation still occurs after packaging.

OBJECTS AND SUMMARY OF THE INVENTION

The objects of the present invention are to provide a packaging container and a packaging method which prevent contamination of foreign particles such as lint and dust or tackiness due to moisture during the transportation and storage of acrylamide crystals.

One of the above object for the present invention can be achieved by providing a packaging container of acrylamide crystals comprising (a) an inner bag consisting of a packaging material having moisture permeability and (b) an interlayer bag consisting of a packaging material having impermeability to atmospheric water-vapor and a gas-barrier property.

Another object of the present invention can be achieved by providing a packaging method for acrylamide crystals comprising the steps of:

(a) filling and sealing acrylamide crystals in an inner bag consisting of a packaging material having moisture permeability, (b) filling and sealing said inner bag and a drying agent in an interlayer bag consisting of a packaging material having impermeability to atmospheric water-vapor and a gas-barrier property, and successively (c) filling and sealing said interlayer bag in an outer bag consisting of an exterior material.

The acrylamide crystals packaged according to the present invention can maintain their stable quality for a long period as a raw material for polyacrylamide having many applications. Particularly in transportation and storage, contamination of lint, dust and other foreign particles or tackiness due to moisture can be prevented. Acrylamide crystals without these troubles are very useful for polyacrylamide gels suitable for electrophoresis in the biochemical field.

DETAILED DESCRIPTION OF THE INVENTION

The moisture content in the acrylamide crystal used in the present invention is maintained usually in the range of 0.1 to 2.0 wt. %, preferably in the range of 0.2 to 1.0 wt. %. Too high a moisture content leads to moisture condensation on the inside surface of the inner bag or causes tackiness.

The packaging material of the inner bag in the present invention includes an air-permeable plastic film, a non-woven fabric, a sheet made of polyethylene fiber, and a synthetic resin sheet having many pores. Materials which have moisture permeability and do not cause contamination due to generation of lint etc. may be used for the inner bag. Practically, materials which may be used have a moisture permeability of at least 300 g/m$^2$.24 hr, preferably at least 400 g/m$^2$.24 hr (measured at 40° C. in 90% RH in accordance with JIS Z-0208). Exemplary plastic films include ESPOIR (trade mark of Mitsui Toatsu Chemicals Inc.) which is an air-permeable film prepared by blending polyethylene with an inorganic filler and film-forming the molten composition obtained. Nonwoven fabrics are prepared from pulp, polyester, polypropylene, polyethylene and nylon. Nonwoven fabrics having excellent air permeability include, for example, AKSTAR (trade mark of Toray Co., Ltd.). Exemplary sheets made of polyethylene fiber include TYVEK (trade mark of E.I. Du Pont De Nemours & Co.) which is prepared by adhering polyethylene fiber to each other by heat and pressure.

Sealing of the inner bag is usually conducted by folding the bag and applying a pressure-sensitive adhesive tape, or conducted by using heat-sealing equipment.

The packaging material used for the interlayer bag in the present invention is a material which is impermeable to water-vapor in the air and has a gas-barrier property in accordance with ASTM D-1434. Practically, the material which may be used has a water-vapor permeability of 10 g/m$^2$.24 hr or less at 40° C. in 90% RH and a gas-barrier property of 50 cc/hr.m$^2$ or less as oxygen permeability. Exemplary interlayer bags include heavy-duty packaging bags of synthetic resins such as polyethylene, polypropylene and polyvinylidene chloride, synthetic resin laminated sheet and aluminum laminated sheet. When the interlayer bag has sufficient strength for heavy-duty packaging and ability for preventing the effect of visible and ultraviolet light during transportation and storage, the use of outer bags described below can be omitted.

The interlayer bag is sealed usually by use of heat-sealing equipment at 130° to 190° C., preferably at 150° to 180° C.

The packaging material for the outer bag of the present invention can be used as long as the material has sufficient strength for heavy-duty packaging and ability to prevent the effect of visible and ultraviolet light during transportation and storage. Practically, the material includes, for example, a synthetic resin sheet, a plastic bottle, a metallic can, a pail can, a corrugated box, a heavy-duty kraft paper, a coated paper and other miscellaneous containers.

Sealing of the outer bag is usually carried out by use of a sewing machine for heavy-duty packaging.

The drying agent for use in the present invention is a packaging drying agent or its equivalent and can be used as long as the drying agent is packed in a cloth bag, a perforated container or a bag of nonwoven fabric. The drying agent is usually placed between the inner and the interlayer bag. The drying agent may be placed in the inner bag in the case where the package of the drying agent does not generate lint even though the package is damaged in use.

Exemplary drying agents include silica gel, calcium chloride, magnesium sulfate, disodium hydrogenphosphate, calcium oxide and phosphoric anhydride. The drying agent is used usually in an amount of 100 to 500 g per 10 kg of crystallized acrylamide to be packed.

The present invention will hereinafter be illustrated by way of examples. However, these examples are not to be constructed to limit the scope of the present invention.

EXAMPLE 1

An aqueous acrylamide solution was concentrated at 50° to 60° C. and cooled to 2° to 3° C. The precipitated crystals were filtered and dried at 50° C. The acrylamide crystals thus obtained contained 0.45 wt. % of moisture and no contamination of foreign particles was found. The crystals could be used for biochemistry and other particular applications.

A bag made of high density polyethylene fiber TYVEK (trade mark of E.I. Du Pont De Nemours & Co.) having a moisture permeability of 688 g/m$^2$.24 hr was used as an inner bag and 10 kg of acrylamide crystal obtained above was charged. The bag was made of a sheet like material obtained by spinning a high density polyethylene and adhering the resulting fiber cloth with heat and pressure. The filled inner bag was placed in an interlayer bag composed of commercial heavy-duty packaging polyethylene having a thickness of 0.1 mm and a moisture permeability of 5 g/m$^2$.24 hr. The top of the inner bag was closed by folding. Thereafter 100 g of silica gel drying agent for packaging which had been previously packed in a Japanese paper bag was placed in the interlayer bag and the interlayer bag was heat-sealed at 170° C. Further the interlayer bag was placed in a packaging bag of multi-ply kraft paper and sealed.

The package of acrylamide crystals thus obtained was stored for 10 days in an indoor storage area without temperature control. Thereafter the package was opened and examined. No moisture condensation was observed in either the inner or interlayer bags. No tackiness was found on the acrylamide crystals. The crystals had the same quality as when packaged. Further, solubility of the acrylamide crystals in water was examined, and no problem was observed at all. No contamination of foreign particles due to the packaging material was found.

EXAMPLE 2

A packaging bag ESPOIR (trade mark of Mitsui Toatsu Chemicals Inc.) which was prepared from an inorganic filler and polyethylene was used as an inner bag. The blending ratio of the inorganic filler to polyethylene was 1:1-1.5 by weight. The inorganic filler was a mixture of $CaCO_3/BaSO_4$ at a ratio of 1:0.1-1.0. The inner bag had a thickness of 0.1 mm and a moisture permeability of 1060 g/m$^2$.24 hr.

The same acrylamide crystal as used in Example 1 was packaged by the same procedures as described in Example 1 except that the above bag was used as an inner bag. After storing for 10 days in an indoor storage area, the package was opened and examined. No moisture condensation was found in either the inner or interlayer bags. No tackiness was observed on the acrylamide crystals. The crystals had the same quality as when packaged. Further, solubility of the acrylamide crystals in water was examined, and no problem was observed at all. No contamination of foreign particles due to the packaging material was found.

EXAMPLE 3

The package of multi-ply kraft paper prepared in Example 1 by using TYVEK as the inner bag and the package of multi-ply kraft paper prepared in Example 2 by using ESPOIR as the inner bag were used.

Both packages above were put on a car and subjected to repeated transportation for 10 days. Thereafter these packages were opened and examined. Nothing abnormal was found at all as in the case of storing in an indoor storage area. The crystals had the same quality as when packaged.

COMPARATIVE EXAMPLE 1

The same acrylamide crystal as used in Example 1 was charged to a commercial polyethylene bag which had a thickness of 0.1 mm and a moisture permeability of 5 $g/m^2.24$ hr and used as an inner bag. The top of the inner bag was folded. The inner bag was placed in an interlayer bag which was the same polyethylene bag as used for the inner bag. The interlayer bag was heat-sealed at 180° C. after addition or without addition of 100 g of silica gel drying agent to the space between the inner and the interlayer bag. The sealed interlayer bags obtained were further packaged in multi-ply kraft paper bags. The packages thus obtained were stored for 10 days in an indoor storage area and then opened and examined.

In all bags, some moisture condensation was observed on the inside surface of the inner bag and some tackiness of the crystals was also found.

COMPARATIVE EXAMPLE 2

Storing test was carried out for 10 days by repeating the same procedures as described in Example 1 without using the drying agent.

As a result, some moisture condensation was found on the inside surfaces of both the inner and interlayer bags. Some tackiness of the acrylamide crystals were also observed.

What is claimed is:

1. A packaging method for acrylamide crystals having a water moisture content of 0.1–2.0% by weight which can cause condensation in a package, comprising the steps of:

(a) enclosing and sealing said acrylamide crystals in an inner bag consisting of a packaging material having moisture permeability of at least 300 $g/m^2.24$ hour at 40° C. in 90% RH, (b) enclosing and sealing said inner bag and drying agent in an interlayer bag consisting of a packaging material having a water-vapor permeability of 10 $g/m^2.24$ hours or less at 40° C. in 90% RH and a gas barrier property, and (c) enclosing and sealing said interlayer bag in an outer bag consisting of an exterior material; so that the moisture vapor from the acrylamide crystals permeate through the inner bag into the interlayer bag where it is absorbed by the drying agent, thereby preventing condensation of the moisture vapor on the inside surface of the inner bag.

2. The packaging method of claim 1 wherein the inner bag consists of a packaging material selected from the group consisting of a nonwoven fabric comprised of pulp or synthetic resin fiber, and a synthetic resin sheet having many pores.

3. The packaging method of claim 1 wherein the interlayer bag consists of a packaging material selected from the group consisting of a synthetic resin sheet, a synthetic resin laminated paper and an aluminum laminated sheet.

4. The packaging method of claim 1 wherein the outer bag consists of an exterior material selected from the group consisting of a synthetic resin sheet, a plastic bottle, a metallic can, a pail can, a corrugated box and a multi-ply kraft paper.

5. The packaging method of claim 1 wherein the drying agent is selected from the group consisting of silica gel, calcium chloride, disodium hydrogenphosphate, magnesium sulfate, calcium oxide and phosphoric anhydride.

* * * * *

UNITED STATES PATENT AND TRADEMARK OFFICE

CERTIFICATE OF CORRECTION

PATENT NO. : 5,111,640

DATED : May 12, 1992

INVENTOR(S) : Tokunaga et al.

It is certified that error appears in the above-identified patent and that said Letters Patent is hereby corrected as shown below:

ON THE TITLE PAGE:

In the Foreign Application Priority Data, please amend "Sep. 5, 1990" to --Sep. 5, 1989--.

Signed and Sealed this

Twenty-first Day of September, 1993

Bruce Lehman

*Attest:*

BRUCE LEHMAN

*Attesting Officer*

*Commissioner of Patents and Trademarks*